US006850200B2

(12) United States Patent
Tracy et al.

(10) Patent No.: US 6,850,200 B2
(45) Date of Patent: Feb. 1, 2005

(54) COMPACT PIFA ANTENNA FOR AUTOMATED MANUFACTURING

(75) Inventors: James L. Tracy, Coral Springs, FL (US); Ulf Jan-Ove Mattsson, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/460,958

(22) Filed: Jun. 13, 2003

(65) Prior Publication Data

US 2004/0252062 A1 Dec. 16, 2004

(51) Int. Cl.[7] ..... H01Q 1/24
(52) U.S. Cl. ..... 343/702; 343/700 MS
(58) Field of Search ..... 343/700 MS, 702, 343/829, 830, 846, 803, 806

(56) References Cited

U.S. PATENT DOCUMENTS 6,114,996 A * 9/2000 Nghiem ..... 343/700 MS
6,339,402 B1 * 1/2002 McKivergan ..... 343/702
6,353,443 B1 * 3/2002 Ying ..... 345/702
6,414,641 B1 * 7/2002 Carlson et al. ..... 343/702
6,456,243 B1 9/2002 Poilasne et al. ..... 343/700 MS
6,573,867 B1 * 6/2003 Desclos et al. ..... 343/700 MS
6,717,551 B1 * 4/2004 Desclos et al. ..... 343/700 MS

* cited by examiner

*Primary Examiner*—Tho Phan
(74) *Attorney, Agent, or Firm*—Fleit, Kain, Gibbons, Gutman, Bongini & Bianco P.L.

(57) ABSTRACT

An RF Parallel Inverted "F" Antenna (PIFA) antenna (101) that is suitable for incorporation into wireless devices constructed with automated manufacturing techniques. The PIFA antenna (101) includes a first arm (102) and a parallel second arm (104) connected by a conductive bridge (106). An RF feed (108) is attached to one end of the first arm (102) and is used to physically and electrically mount the compact PIFA antenna (101). An opposite end of the compact PIFA antenna (101) includes a support structure (150) that provides stability and support of the compact PIFA antenna (101) during construction of a circuit board on which it is mounted. The end support (150) is designed to minimize the use of insulating material to minimize dielectric effects upon the radiation pattern of the conductive elements of the compact PIFA antenna (101) all while maximizing the mechanical stability of the component during secondary manufacturing operations.

27 Claims, 4 Drawing Sheets

COMPACT PIFA ANTENNA FOR AUTOMATED MANUFACTURING

FIELD OF THE INVENTION

The present invention generally relates to the field of radio frequency antennas and more particularly to compact, multiple band antennas.

BACKGROUND OF THE INVENTION

Radio communications devices are increasingly being used to communicate in multiple RF bands. An example of multiple band RF devices is a device that is able to communicate by using either the 802.11(b) or the 802.11(a) standard. The 802.11(b) standard uses RF signals in the region near 2.4 GHz and the 802.11(a) standard uses RF signals in the region near 5.0 GHz. It is often desirable, especially in small and/or portable devices, to minimize the number of antennas that are used on the device, and using a single antenna to cover multiple bands generally provides savings in size and manufacturing cost.

RF antennas frequently have fragile physical structures that are irregularly shaped. This characteristic increases the difficulty of integrating RF antennas with communications devices. The size of microwave band antennas generally makes it practical to mount a microwave antenna directly on a circuit board within a portable device, but designs to do so are hampered by the fragility of microwave antenna designs and the difficulty of handling microwave antenna structures with automated part placement machinery. Automated circuit board manufacturing processes frequently use Infra-Red Solder Reflow Ovens that require the electronic components being mounted on the board to withstand heat of the oven while staying in place and not deforming. Many microwave antenna structures are either too fragile or not well suited for Solder Reflow Ovens. The use of additional non-conductive material to enclose or otherwise provide a more easily handled "package" can also affect the electrical and radiation performance of the antenna.

Therefore a need exists to overcome the problems with the prior art as discussed above.

SUMMARY OF THE INVENTION

According to a preferred embodiment of the present invention, as shown in FIG. 1 an antenna has a first arm (102) with a first end (122) and an opposite end (124) and a second arm, (101) that is substantially parallel to, co-planar with, and separated from the first arm. The second arm has a first end (128) that is substantially aligned with the first end of the first arm. The antenna further has a conducing bridge (132) that is electrically connected to the first end of the first arm and the first end of the second arm. The antenna further has a feed element (108) that is electrically connected to the opposite end of the first arm and that is used for connection to an RF feed.

According to a preferred embodiment, an antenna and a device utilize the significant advantages of the present invention.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms as described in the non-limiting exemplary embodiments of FIGS. 3, 4, 5 and 6. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

The present invention, according to a preferred embodiment, overcomes problems with the prior art by providing a compact Parallel Inverted "F" Antenna (PIFA) antenna structure that includes a flat vacuum target area 134 on its top side to facilitate picking and placing of the compact PIFA antenna by an automated pick and place machine. The preferred embodiment further includes a non-conductive support structure 150 on an end opposite the electrical connections to improve stability of the device for automated soldering into place. This non-conductive support structure has a design that minimizes the amount of insulating material in the structure so as to minimize the dielectric impact of the insulating material on the electrical and radiation characteristics of the antenna structure. The compact PIFA antenna of the exemplary embodiment is further dimensioned to have a small size and to perform as a dual band antenna with efficient radiation characteristics in the RF bands near 2.4 GHz and 5.0 GHz. Providing efficient radiation characteristics in these two bands facilitates the use of this antenna in a compact device that is able to operate using ether the 802.11(b) and 802.11(a) standard by using the same compact PIFA antenna of the exemplary embodiment.

Figure 1:
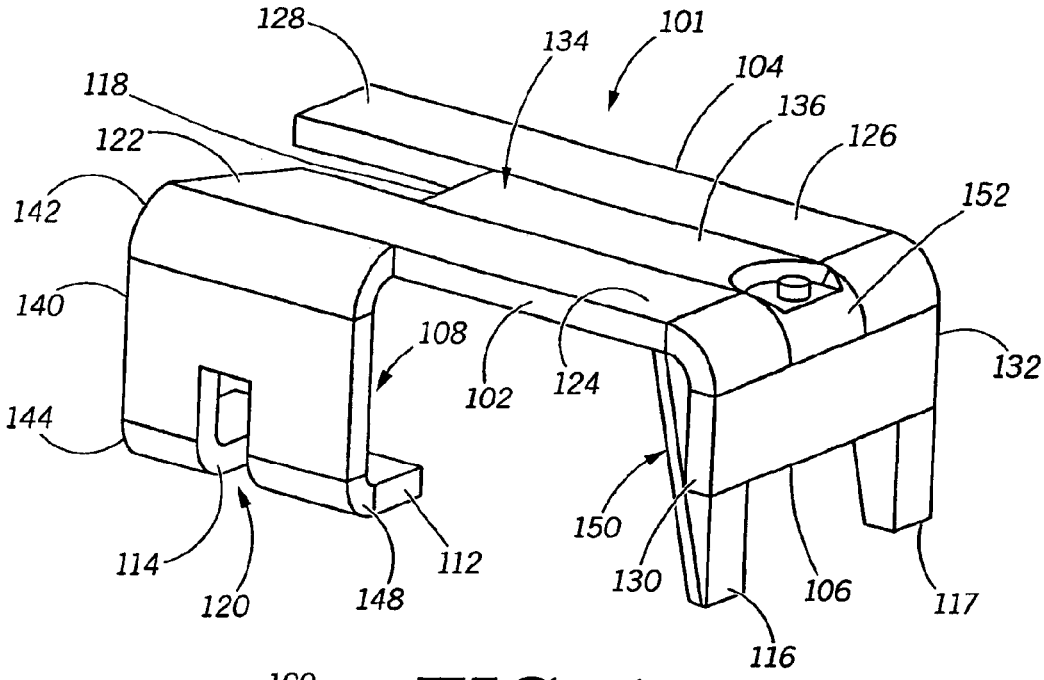
FIG. 1 is a first isometric view as viewed primarily from a top perspective, or outside of a compact PIFA, according to a preferred embodiment of the present invention.

A first isometric view 100 of a compact PTA 101 according to an exemplary embodiment of the present invention is illustrated in FIG. 1. The compact PIFA 101 of the exemplary embodiment has a first arm 102. The first arm 102 of the exemplary embodiment has a first end 124 that is electrically connected to a first end 130 of a conducting bridge 106. The compact PIFA 101 of the exemplary embodiment further has a second arm 104 that has a first end 126 that is substantially aligned with the first end 124 of the first arm 102. The first end 126 of the second arm 104 is electrically connected to a second end 132 of the conducting bridge 106, which is opposite the first end 130 of the conducting bridge 106. The second arm 104 is parallel to the first arm 102 and separated from the first arm 102 by a gap 134. The first arm 102 and the second arm 104 of the exemplary embodiment are connected to the conducting bridge 106 via arcuate beams to minimize the RF losses and improve the AC electrical characteristics of the compact PIFA antenna 101.

The compact PIFA 101 further has a feed element 108 that is electrically connected to and that depends from a second end 122 of the first arm 102, which is the end that is opposite the first end 124. The feed element 108 of the exemplary embodiment has a generally rectangular conductive sheet 140 that forms a plane that is perpendicular to the first arm 102. This conductive sheet 140 has a major axis that is co-linear with the length of the first arm 102. The conductive sheet 140 and the first arm 102 in the exemplary embodiment are connected by an arcuate connector 142. The arcuate design of the arcuate connector 142 minimizes RF losses at the transition. The end of the feed element 108 that is opposite the arcuate connector 142 has a slot 120 to facilitate proper generation of RF currents within the conductive sheet 140. The second end 122 of the first arm 102 of the exemplary embodiment has a tapered cut. The tapered cut of the second end 122 of the first arm 102 results in the first arm 102 being longer along the edge that connects to the feed element 108 than it is along the edge opposite to the feed element 108.

The feed element 108 further has a ground contact 114 and an RF contact 112. The ground contact 114 and RF contact 112 connect to the end of the conductive sheet 140 that is opposite the first arm 102. The ground contact 114 and RF contact 112 in the exemplary embodiment connect to the conductive sheet via a ground arcuate connector 144 and an RF arcuate connector 148, respectively. The ground contact 114, the RF contact 112, the ground arcuate connector 144 and the RF arcuate connector 148 are all separated by a gap 120 in the exemplary embodiment. This gap 120 extends into the conductive sheet 140.

The RF contact 112 and the ground contact 114 are typically connected, both electrically and physically, to contacts on a printed circuit board (not shown). The feed element 108 of the exemplary embodiment also has a height that is greater than the distance that the conductive bridge 106 extends below the first arm 102 and the second arm 104. This results in the bottom of the conducting bridge 106 being positioned at a distance above the printed circuit board to which the feed structure 108 is connected. In order to improve the stability, strength and mountability of the compact PIFA antenna 101 of the exemplary embodiment, a support structure 150 is attached to the end of the compact PIFA antenna 101 that is opposite the feed structure 108.

The exemplary embodiment has a support structure 150 that is constructed of an insulating material, such as Liquid Crystal Polymer (LCP) or Kevlar, that is able to withstand the heat of solder reflow that is encountered during a circuit board manufacturing process. This exemplary embodiment uses a polymer material that is sold under the trademark "Vectra-A130" for standard temperature use, and a polymer material sold under the trademark "Vectra-E130" for higher temperature use, as is typically used in solder reflow ovens. The support structure 150 of the exemplary embodiment allows the compact PIFA antenna 101 to be placed and stably stand on a flat surface, such as a printed circuit board, without additional fixtures or other support, after the action of vacuum placement by an automated placement machine, as the antenna is extracted from the antenna packaging that generally consists of industry standard Tape& Reel packaging. The support structure 150 of the exemplary embodiment includes elements that are visible in the first isometric view 100, including a first leg 116, a second leg 117, a top filler 118 and a gap end 152. The support structure 150 of the exemplary embodiment is designed to use a minimum amount of material so as to minimize the dielectric effect of the insulating material on the electrical characteristics of the conductive antenna structure. The support structure 150 of the exemplary embodiment is also designed to better allow the compact PIFA antenna 101 to remain in place and not tip over during automated placement on a circuit board and during the reflow solder process.

The support structure 150 is attached to the conductive elements of the compact PIFA antenna 101 according to the natural surface adhesion present during the injection molding operation evident between the insulating material and the conductive material in which it is in contact. In addition to this bonding action, embodiments of the present invention improve the adhesion of the support structure 150 with the conductive members of the compact PIFA antenna 101 by forming one or more features on one or more surfaces that come into contact with the support structure 150. An example of such a structure is a geometric shape that is raised depressed, or "coined" into the edges of the arms 102 and 104 that comes into contact with the filler 118. This recessed geometric shape feature of the exemplary embodiment is able to allow the free-flowing injection molded insulation material to flow into, and to solidify, thereby "locking" the frozen insulator material into position between the two primary conductive elements of the invention.

The top filler 118 of the exemplary embodiment extends from the opening in the gap 134 that is formed near the first end 124 of the first arm 102 and the first end 126 of the second arm 104 and extends only part way down the gap 134 between the first arm 102 and the second arm 104. This reduces the amount of insulating material present in the support structure 150 as compared to a support structure 150 that has a top filler 118 that extends for the entire length of the first arm 102 and the second arm 104. The compact PIFA antenna 101 of the exemplary embodiment has a vacuum target area formed by the 3 elements being, top filler 118 and a portion of both the first arm 102 and the second arm 104. This vacuum target area advantageously allows, for example, an automated, vacuum actuated pick and place machine, or a robotic end-effector, to pick up the compact PIFA antenna 101 of the exemplary embodiment and place it as needed on a circuit board for automated soldering.

Figure 2:
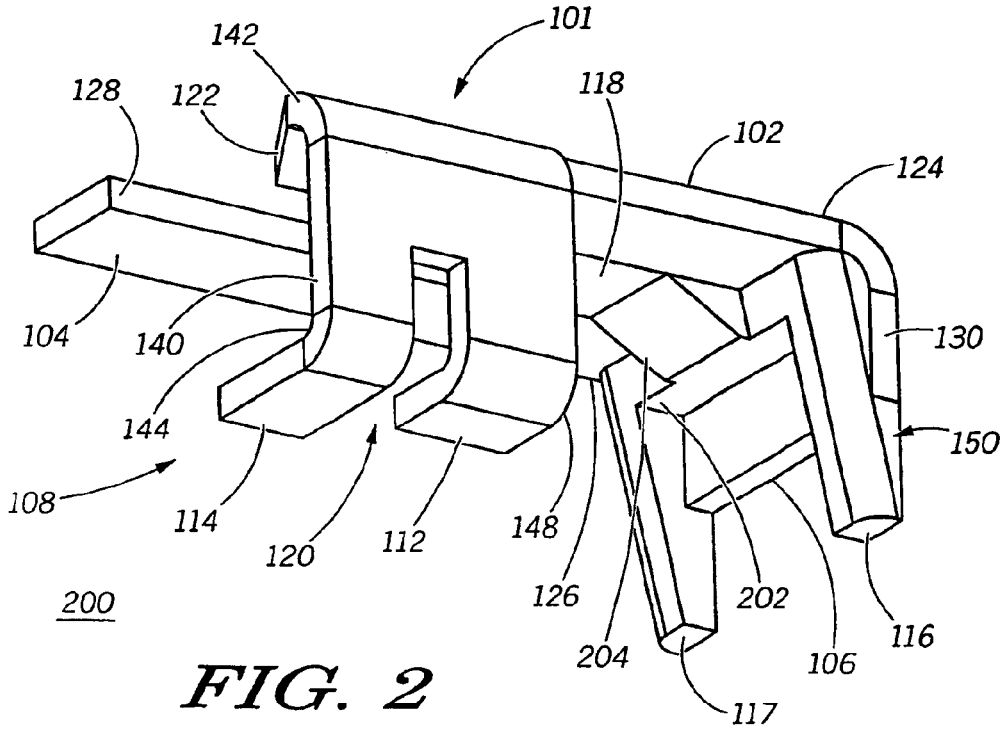
FIG. 2 is a second isometric view as viewed primarily from the underside of a compact PIFA, according to a preferred embodiment of the present invention.

A second isometric view 200 of a compact PIFA 101 according to an exemplary embodiment of the present invention is illustrated in FIG. 2. The second isometric view 200 shows a view of the compact PIFA antenna 101 from below the plane formed by the first arm 102 and the second arm 104 of the exemplary embodiment. Of particular interest are the additional elements of the support structure 150 that are visible herein. The top of the first leg 116 and the top of the second leg 117 are connected by a cross-beam 202. The top of the cross-beam 202 begins at the bottom of the first arm 102 and the second arm 104 and descends a distance less than the height of the conducting bridge 106. Cross-beam 202 is used to provide stability and strength to the legs of the support structure 150, such as the first leg 116 and the second leg 117. The cross-beam 202 further provides additional area for bonding between the conductive bridge 106 and the support structure 150. Further structural strength and stability is provided to the support structure 150 of the exemplary embodiment by the wedge 204 that forms an additional support between the cross-beam 202 and the gap filler 118, all of which maintains a minimum volume of plastic to achieve all of this functionality, due to the desire to minimize surrounding dielectric effects on the radiating elements, including the first arm 102 and the second arm 104.

Figure 3:
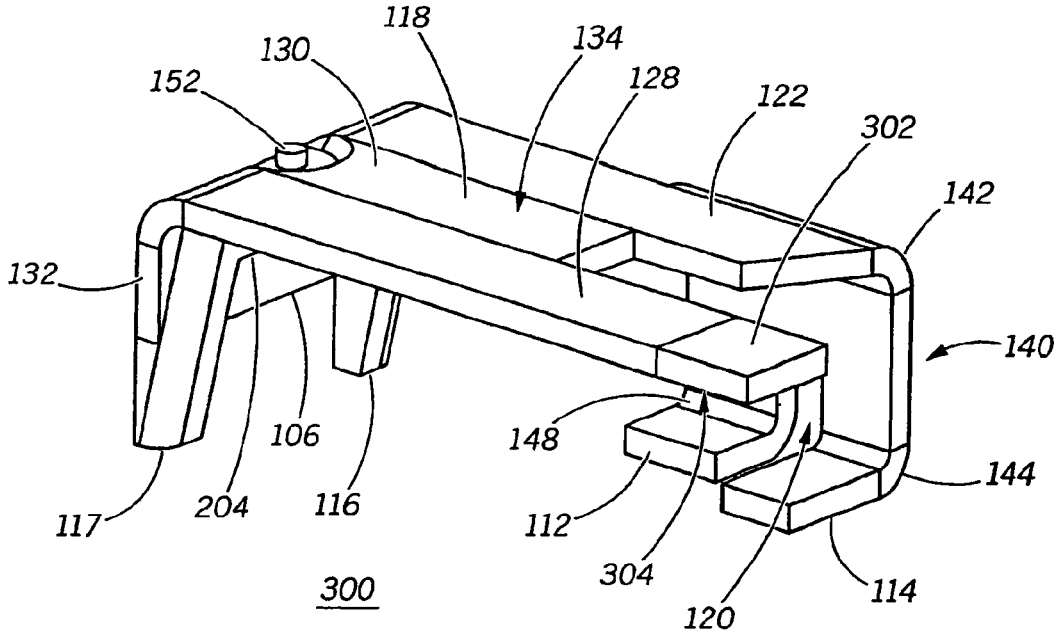
FIG. 3 is an isometric view of a first alternative compact PIFA antenna according to a first alternative embodiment of the present invention.

An isometric view of a first alternative compact PIFA antenna 300 according to a first alternative embodiment of the present invention is illustrated in FIG. 3. The design of the first alternative compact PIFA antenna 300 is similar to the design of the compact PIFA antenna 101 described earlier. The tapered cut of the second end 122 of the first arm 102, as is present in the compact PIFA antenna 101 of the exemplary embodiment, is more clearly shown in this view. The first alternative compact PIFA antenna 300 further includes an end section 304 that is an increased length of the second arm 104, which is shown as a beam extension 302 for clarity. The second arm 104 of the first alternative compact PIFA antenna 300 is a continuous piece of conductor and the beam extension 302 is not separated from the rest of the second arm 104 in this embodiment. This additional length is used to alter the electrical and radiation characteristics of the compact PIFA antenna.

Figure 4:
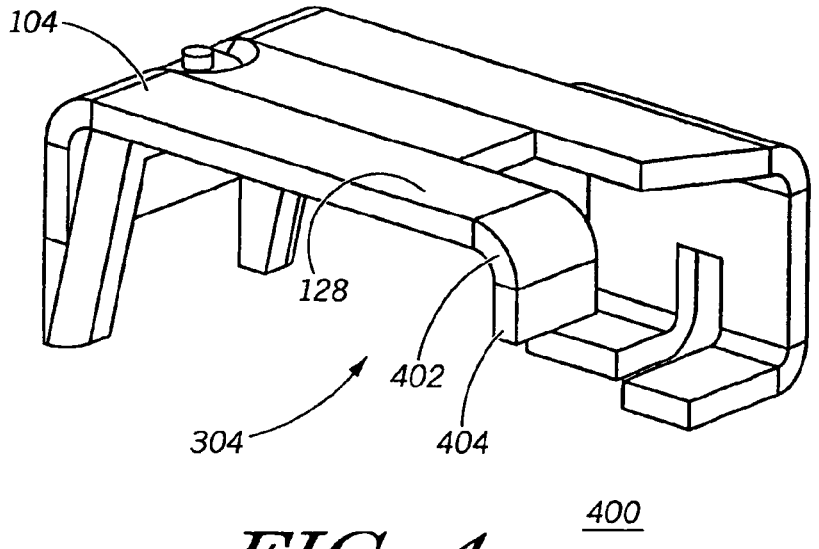
FIG. 4 is an isometric view of a second alternative compact PIFA antenna according to a second alternative embodiment of the present invention.

An isometric view of a second alternative compact PIFA antenna 400 according to a second alternative embodiment of the present invention is illustrated in FIG. 4. The design of the second alternative compact PIFA antenna 400 is similar to the design of the compact PIFA antenna 101 described earlier. The second alternative compact PIFA antenna 400 further includes an end section 304 that has a vertical conductive beam 404 that forms a plane that is perpendicular to the plane of the second arm 104. The vertical conductive beam of the second alternative embodiment is physically and electrically connected to the second end of the second arm 104 by an arcuate connector 402.

Figure 5:
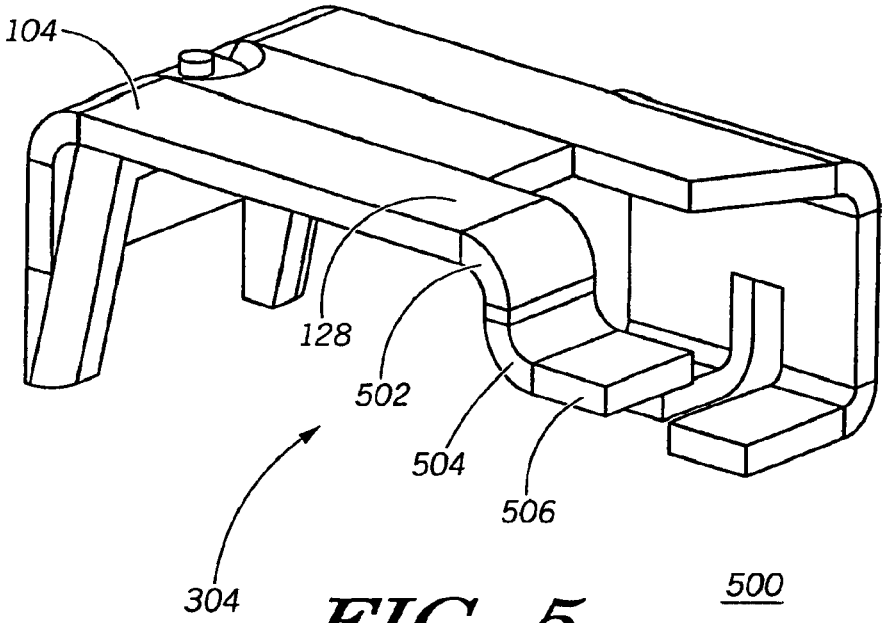
FIG. 5 is an isometric view of a third alternative compact PIFA antenna according to a third alternative embodiment of the present invention.

An isometric view of a third alternative compact PIFA antenna 500 according to a third alternative embodiment of the present invention is illustrated in FIG. 5. The design of the third alternative compact PIFA antenna 500 is similar to the design of the compact PIFA antenna 101 described earlier. The third alternative compact PIFA antenna 500 further includes and end section 304 that includes two arcuate sections, a first arcuate section 502 and a second arcuate section 504, which create an "S" shaped structure that depends from the second end of the second arm 104. The end of the second arcuate section 504 further has an additional beam 506 that has a cross-section similar to the second arm 104.

Figure 6:
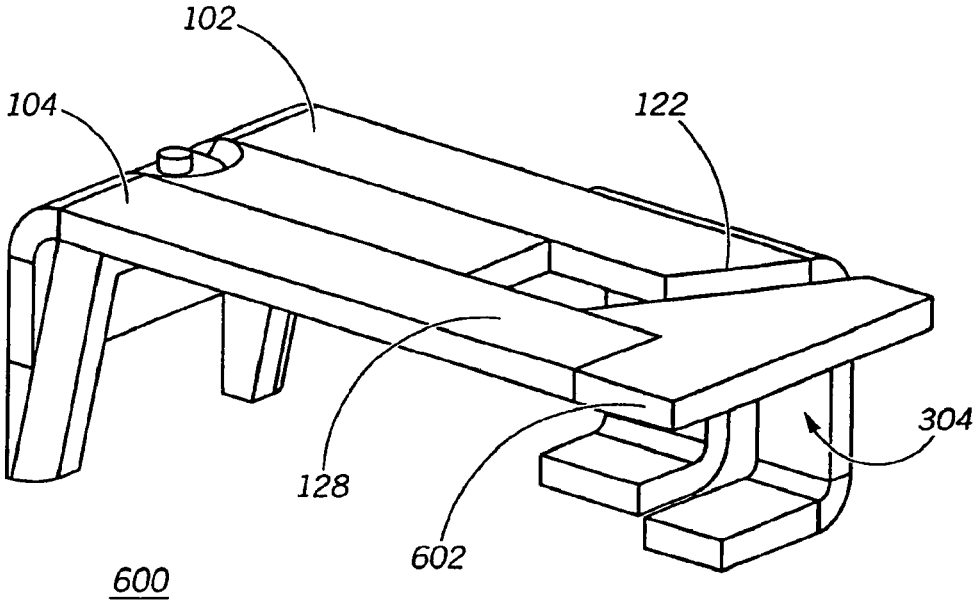
FIG. 6 is an isometric view of a fourth alternative compact PIFA antenna according to a fourth alternative embodiment of the present invention.

An isometric view of a fourth alternative compact PIFA antenna 600 according to a fourth alternative embodiment of the present invention is illustrated in FIG. 6. The design of the fourth alternative compact PIFA antenna 600 is similar to the design of the compact PIFA antenna 101 described earlier. The fourth alternative compact PIFA antenna 600 further includes an end section 304 that includes an end conductor 602 that is able to have an arbitrary geometry, including rectangular, circular, elliptical, or trapezoidal or otherwise geometrical in appearance. These shapes can be selected to affect the performance of the radiated signal. The end conductor 602 is connected to the second end of the second arm 104 of this embodiment. The second arm 104 of the fourth alternative compact PIFA antenna 600 is a continuous piece of conductor and the end conductor 602 is not separated from the rest of the second arm 104 in this embodiment. The end conductor 602 of the fourth exemplary embodiment comprises an outwardly expanding shape. Note that other end shapes should become obvious to those of ordinary skill in the art in view of the present discussion. For example, a bulbous rectangular, circular, elliptical, or trapezoidal or otherwise geometrical end shape for the end conductor 602 is anticipated by alternative embodiments of the present invention.

The exemplary embodiment selected conductive members, which are all members that are not part of the support structure 150 of the exemplary embodiment, that are preferably made from 0.020 inch thick copper sheet metal. The use of 0.020 inch thick copper was selected to provide sufficient physical strength to support the use of automated manufacturing processes, such as automated pick and place procedures and solder reflow IR ovens with the exemplary embodiment. Other materials are able to be used with similar effectiveness, such as 0.010 inch thick brass and metals, including copper, of other thicknesses as is obvious to those of ordinary skill in the relevant arts in light of the teachings herein.

The exemplary embodiment of the present invention is designed to operate within two frequency bands. A single antenna structure, according to a preferred embodiment of the present invention, is able to wirelessly communicate signals, e.g., transmit and/or receive RF signals, such as according to either the 802.11(b) or the 802.11(a) standards. The 802.11(b) standard uses RF signals in the region near 2.4 GHz and the 802.11(a) standard uses RF signals in the region near 5.0 GHz. A preferred embodiment of the present invention can operate as an RF antenna in compliance with the 802.11(b) and/or the 802.11(a) standards. Also, an alternative exemplary embodiment of the present invention may provide a Bluetooth RF antenna structure that can operate at two frequency bands. Other multiple frequency band applications using a single antenna structure, as discussed above, should be obvious to those of ordinary skill in the art in view of the present discussion. This novel feature provided by the alternative exemplary embodiments, as discussed above, is a significant advantage of the present invention.

Additionally, in an exemplary embodiment, the first arm 102 and the second arm 104 each preferably have a width of 2.0 millimeters (mm). The width of the gap 134 between the first arm 102 and the second arm 104 is also preferably 2.0 mm. The length of the second arm 104 is preferably 11.0 mm from the tip of its second end 128 to inner surface of the conductive bridge 106. The length of the first arm 102 from the tip of its second end 122 to the inner surface of the conductive bridge 106 is preferably 10.5 mm. The conductive bridge 106 of the exemplary embodiment extends preferably to a point that is 2.25 mm below the bottom surface of the first arm 102 and the second arm 104. The support structure 150 extends preferably 4.0 mm from the bottom of the first arm 102 and the second arm 104 so as to end at a point on a plane formed by the bottom of the ground contact 112 and the bottom of the RF contact 114. The width of the ground contact 112 of the exemplary embodiment is preferably 2.0 mm and the width of the RF connector 114 is preferably 1.5 mm. The total width of the feed element 108 is preferably 4.0 mm in the exemplary embodiment.

Figure 7:
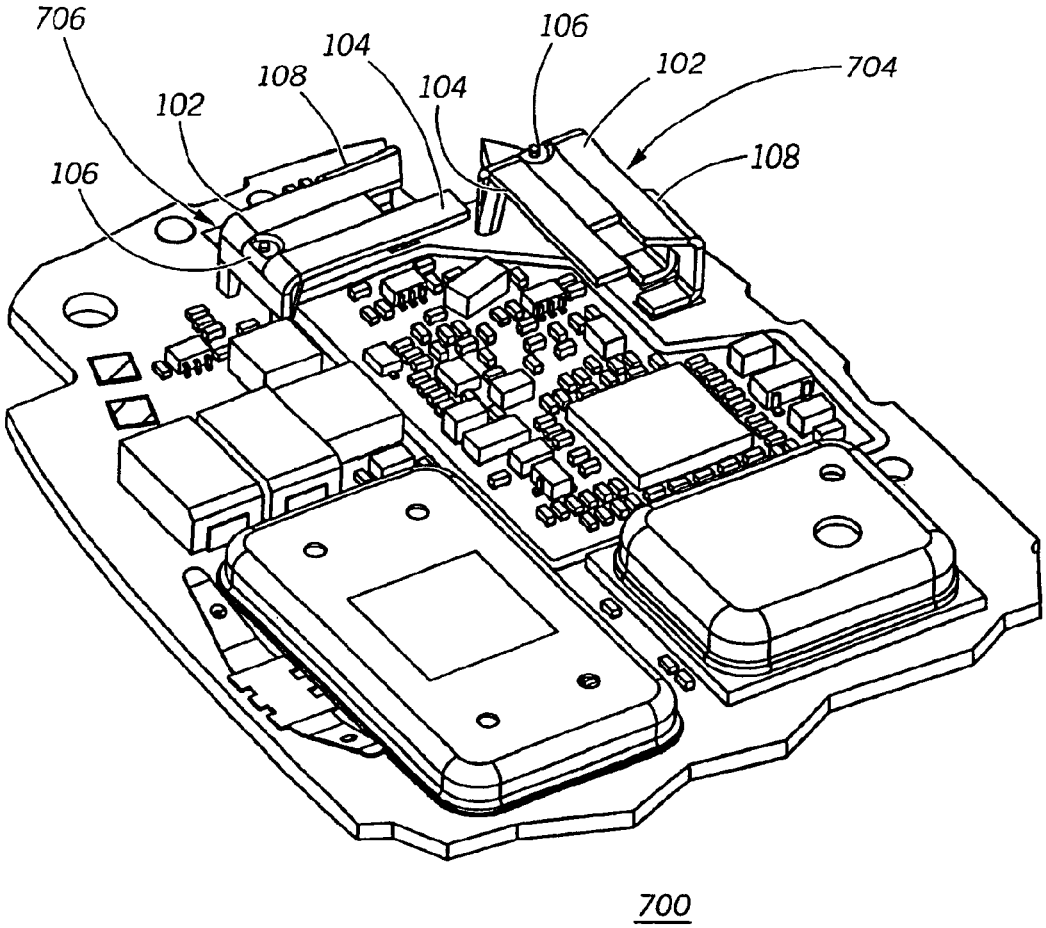
FIG. 7 is a cutaway view of a wireless device incorporating two compact PIFA antennas, as are shown in FIG. 1, to provide diversity, according to an exemplary embodiment of the present invention.

The small size and light weight of the compact PIFA antenna 101 of the exemplary embodiment allows multiple compact PIFA antennas to be incorporated into a device. With the continuous miniaturization of wireless devices, the ability to combine multiple compact PIFA antennas into a single miniaturized electronic device, such as a cellular telephone, a two-way portable radio, and/or a wireless communicator, is a valuable advantage of the present invention. The use of two such antennas that are oriented at right angles to each other allows the wireless device to operate with diversity. A cutaway view of an exemplary wireless device 700 with two such compact PIFA antennas according to an embodiment of the present invention is illustrated in FIG. 7. The exemplary wireless device 700 has a case 710 and a printed circuit board 702. The printed circuit board of this exemplary device was constructed, populated and soldered using automated techniques that advantageously reduce costs. This printed circuit board 702 includes, inter alia, two compact PIFA antennas, a first PIFA compact antenna 704 and a second compact PIFA antenna 706. Note that other circuits have been removed from this view in FIG. 7 for simplicity of the present discussion. However, it should be obvious to those of ordinary skill in the art that those other circuits, such as processors, memory devices, user interfaces, transmit and receive circuits, and other such component circuits, are commonly used in combination with the two compact PIFA antennas to fully implement a wireless device, such as a cellular telephone, a two-way portable radio, and/or a wireless communicator. Each of these two antennas are oriented on the printed circuit board 702 at right angles to each other and thereby each compact PIFA antenna generates and receives RF signals that are at cross polarizations relative to the signals generated and received by the other antenna. This provides the wireless device with polarization diversity to accommodate different orientations of the exemplary wireless device 700. Conventional techniques are used to select which of the two compact PIFA antennas, and therefore which polarization, to use at a given time.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. An antenna, comprising:

a first arm with a first end and an opposite end;

a second arm, substantially parallel to, co-planar with, and separated from the first arm along a length of the first arm and the second arm, and with a first end that is substantially aligned with the first end of the first arm;

a conducting bridge, electrically connected to the first end of the first arm and the first end of the second arm;

a feed element, electrically connected to the opposite end of the first arm, for connection to an RF feed; and a non-conductive support depending from the conducting bridge.

2. The antenna of claim 1, wherein the conducting bridge comprises a conductive sheet forming a plane that is substantially perpendicular to the plane formed by the first arm and the second arm.

3. The antenna of claim 1, wherein the feed element comprises a conductive sheet forming a plane that is substantially perpendicular to the plane formed by the first arm, and wherein the feed element comprises a ground contact and an RF contact, wherein the ground contact and the RF contact each comprise a conductive sheet separated by a gap.

4. The antenna of claim 1, wherein the opposite end of the first arm has a tapered cut.

5. The antenna of claim 1, wherein the second arm is longer than the first arm.

6. The antenna of claim 1, wherein the second arm is shorter than the first arm.

7. The antenna of claim 1, wherein the second arm comprises at least one bend.

8. The antenna of claim 1, wherein the antenna is packaged into a tape and reel packaging.

9. The antenna of claim 1, wherein the feed element extends perpendicularly for a distance from first arm and wherein the non-conductive support extends to the distance.

10. The antenna of claim 1, wherein at least one of the conducting bridge, the first arm, the second arm, and the feed element comprises a feature to facilitate adhesion with the non-conductive support.

11. The antenna of claim 1, wherein the non-conductive support further extends into a gap between the first arm and the second arm.

12. The antenna of claim 1, wherein the non-conductive support comprises a plurality of legs.

13. The antenna of claim 12, wherein at least some of the legs within the plurality of legs taper to a minimum size.

14. The antenna of claim 1, further comprising a non-conductive surface bridging at least part of a gap between the first arm and the second arm.

15. The antenna of claim 14, wherein the non-conductive surface is fabricated with a free flowing injection molding process that allows insulation material to flow into and solidify into position between the first arm and the second arm.

16. The antenna of claim 14, further comprising a flat area for vacuum pickup, wherein the flat area comprises at least one of the non-conductive surface, the first arm and the second arm.

17. The antenna of claim 1, further comprising an end section, wherein the end section is attached to the end of the second arm that is opposite the first and.

18. The antenna of claim 17, wherein the end section comprise a portion that forms a plane that is perpendicular to the plane of the second arm.

19. The antenna of claim 17, wherein the and section comprises a portion that is parallel to and offset from the second arm.

20. The antenna of claim 17, wherein the end section comprises a portion that is coplanar with the second arm and extends into a gap between the first arm and the second arm.

21. The antenna of claim 17, wherein the end section comprises a portion with an arbitrary geometric shape.

22. The antenna of claim 1, wherein the antenna is tuned to operate within a plurality of RF bonds.

23. The antenna of claim 22, wherein the plurality of RF bands comprises a first RF band comprising 2.4 GHz and a second RF band comprising 5.0 GHz.

24. The antenna of claim 23, wherein the first RF band has a bandwidth of about 100 MHz.

25. The antenna of claim 23, wherein the second RF band has a bandwidth of about 1.0 GHz.

26. A wireless device, comprising:

a circuit board for mounting at least one compact PIFA antenna, wherein at least one of the at least one compact PIFA antenna comprises:

a first arm with a first end and an opposite end;

a second arm, substantially parallel to, co-planar with, and separated from the first arm along a length of the first arm and the second arm, and with a first end that is substantially aligned with the first end of the first arm;

a conducting bridge, electrically connected to the first end of the first arm and the first end of the second arm;

a feed element, electrically connected to the opposite end of the first arm, for connection to an RF feed; a a non-conductive support depending from the conducting bridge.

27. An antenna, comprising:

a first arm with a first end and an opposite end;

a second arm, substantially parallel to, co-planar with, and separated from the first arm along a length of the first arm and the second arm, and with a first end that is substantially aligned with the first end of the first arm;

a conducting bridge, electrically connected to the first end of the first arm and the first end of the second arm; and a feed element, electrically connected to the opposite end of the first arm, for connection to an RF feed, wherein the food element comprises a conductive sheet forming a plane that is substantially perpendicular to the plane formed by the first arm, and wherein the feed element comprises a ground contact and an RF contact, wherein the ground contact and the RF contact each comprise a conductive sheet separated by a gap.

* * * * *